United States Patent [19]

Giaimo, Jr.

[11] B 3,986,872

[45] Oct. 19, 1976

[54] METHOD OF INCREASING THE IMAGE EXPOSURE AND DEVELOPING SENSITIVITY OF MAGNETO-ELECTRIC PRINTING SYSTEM

[75] Inventor: Edward Charles Giaimo, Jr., Princeton, N.J.

[73] Assignee: RCA Corporation, New York, N.Y.

[22] Filed: Nov. 22, 1971

[21] Appl. No.: 200,759

[44] Published under the second Trial Voluntary Protest Program on February 3, 1976 as document No. B 200,759.

[52] U.S. Cl. ..... 96/1.4; 96/1 R; 355/3 R; 355/3 DD

[51] Int. Cl.[2] ..... G03G 13/14; G03G 13/22

[58] Field of Search ..... 96/1 R, 1.4, 1.5; 355/17; 250/65 ZE

[56] References Cited

UNITED STATES PATENTS

| | | | |
|---|---|---|---|
| 2,756,676 | 7/1956 | Steinhilper | 96/1 R X |
| 2,798,959 | 7/1957 | Moncrieff-Yeates | 96/1.5 X |
| 2,924,519 | 2/1960 | Bertelsen | 96/1.4 |
| 2,968,552 | 1/1961 | Gundlach | 96/1.4 |
| 3,146,100 | 8/1964 | Kaufman | 355/17 X |
| 3,392,642 | 7/1968 | Germer | 95/1.7 |

OTHER PUBLICATIONS

Translation of Japanese Patent 37–16098, 1963, OTS, Commerce Dept.

*Primary Examiner*—Roland E. Martin, Jr.
*Attorney, Agent, or Firm*—H. Christoffersen; Robert P. Williams; Thomas H. Magee

[57] ABSTRACT

A uniformly electrostatically charged recording element is toned uniformly with magnetic toner particles and exposed simultaneously with both an image exposure and a separate flood light while the recording element is disposed in a magnetic field. The flood light is directed toward the uniformly toned (photoconductive) surface of the recording element while the image exposure is directed preferably onto the opposite (light-transmitting substrate) surface of the recording element.

10 Claims, 3 Drawing Figures

METHOD OF INCREASING THE IMAGE EXPOSURE AND DEVELOPING SENSITIVITY OF MAGNETO-ELECTRIC PRINTING SYSTEM

BACKGROUND OF THE INVENTION

This invention relates generally to the art of magneto-electric printing, and more particularly to a method of increasing the image exposure and developing sensitivity in a magneto-electric printing system employing magnetic toner particles.

By the term "magneto-electric printing system," as used herein, is meant a printing system wherein an image is produced on a recording element with magnetic toner particles that are acted upon by both magnetic and electrostatic forces.

It has been proposed to reproduce an image on a recording element by a magneto-electric printing system employing magnetic toner particles to define the image. In this printing system, the recording element, comprising a photoconductive layer on a light-transmitting substrate, is uniformly electrostatically charged and uniformly toned with magnetic toner particles. The toned and unexposed recording element is then disposed, in darkness, in a sub-threshold magnetic field (a field of magnetic strength insufficient to overcome the electrostatic forces attracting the magnetic toner particles to the recording element in darkness), and then exposed with the image to be reproduced. The resulting increase in the conductivity of the photoconductive layer in the exposed (light-struck) portions reduces the electrostatic attraction between the magnetic toner particles and the photoconductive layer thereat so that the affected magnetic toner particles are removed from the surface of the recording element by the magnetic field. The magnetic toner particles that remain on the recording element define the desired image.

While the aforementioned magneto-electric printing system is satisfactory for many applications, it has been observed, in some cases, that not enough of the magnetic toner particles are removed from those portions of the recording element that have been exposed during the exposure operation. This is especially true when the time of the image exposure is of insufficient duration and/or the intensity of the light image is of insufficient magnitude to increase the conductivity of the photoconductive layer sufficiently to reduce the electrostatic forces thereon. Under these conditions, the magnetic forces on the magnetic toner particles cannot overcome the electrostatic forces thereon to remove them.

SUMMARY OF THE INVENTION

A magneto-electric printing system of the type described is improved by a step (in one embodiment) of directing a flood light toward the toned surface of the recording element during the formation of the image thereon. In another embodiment of the novel method, the flood light and the image exposure are directed to opposite sides, respectively, of the recording element. In still another embodiment of the novel method, the flood light is applied alternately with the magnetic field during the image exposure step.

DESCRIPTION OF THE PREFERRED EMBODIMENTS

Figure 1:
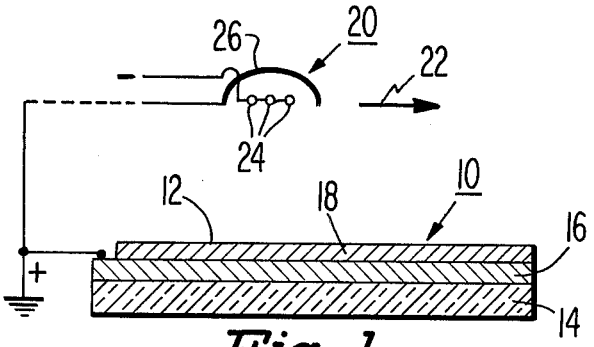
FIGS. 1 and 2 are schematic drawings, in side elevation, of a recording element with apparatus for the charging and toning operations, respectively, of the novel method.

Referring now to FIG. 1 of the drawing, there is shown a recording element 10 upon whose upper surface 12 it is desired to reproduce an image, defined with magnetic toner particles. The recording element 10 is one of the type known in the electrostatic printing art and comprises a light-transmitting substrate 14, a light-transmitting, electrically conductive layer 16 over the substrate 14, and a photoconductive layer 18 over the conductive layer 16.

The substrate 14 is light-transmitting and may comprise a glass plate, plastic material, or paper, for example. The conductive layer 16 may comprise a film of tin oxide and/or indium oxide, well known in the art. The conductive layer 16 is not necessary if the substrate 14 is of relatively electrically conductive material, such as a sheet of paper with a moisture content of about 6 per cent. The photoconductive layer 18 may comprise a spectrally-dyed photoconductor, such as spectrally-dyed zinc oxide in a suitable resin binder, sputtered zinc oxide, or a transparent organic photoconductor in a suitable transparent binder. Suitable photoconductive layers for the photoconductive layer 18 are described in U.S. Pat. No. 3,310,401 for "Electrographic Member and Process Utilizing Polyarylmethane Dye Intermediates."

Means are provided to apply a uniform electrostatic charge on the upper surface 12 of the recording element 10 in darkness. To this end, a corona discharge device 20 is disposed above the surface 12 of the recording element 10 and adapted to be moved in the direction of the arrow 22 by any suitable means. Corona wires 24 of the corona discharge device 20 are connected to a negative terminal of a suitable unidirectional voltage source (not shown) and a shield 26 of the corona discharge device 20 is connected to the positive terminal of the voltage source. The conductive layer 16 is also connected to the positive terminal of the voltage source and grounded. When the corona discharge device 20 is moved over the surface 12 at a distance of about one-half inch therefrom, a negative electrostatic charge is applied to the surface 12. In accordance with the novel method, the surface 12 should be charged substantially uniformly.

The polarity of the electrostatic charge applied to the surface 12 is not critical, and it is within the contemplation of the novel method for the applied electrostatic charge to be either negative or positive. Also, the electrostatic charge may be applied by any suitable means known in the art, other than with a corona discharge device.

Figure 2:
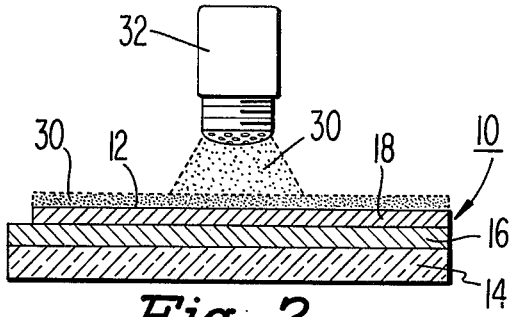

The electrostatically charged surface 12 of the recording element 10 is toned uniformly with magnetic toner particles 30. Referring now to FIG. 2, the recording element 10 is shown in the process of having the magnetic toner particles 30 applied to its upper charged surface 12. The magnetic toner particles 30 are applied to the charged surface 12 from a shaker container 32. The charged surface 12 of the recording element can also be toned uniformly by dipping the electrostatically charged recording element 10 into a reservoir of magnetic toner particles 30 and removing the recording element therefrom and shaking it. The charged surface 12 can also be toned uniformly by cascading the magnetic toner particles 30 over it when it is inclined. The magnetic toner particles are attracted by the electrostatic charges on the surface 12, and, if the magnetic toner particles 30 are electrically neutral, they adhere to the charged surface 12 by electrostatic induction. If electrostatically charged (electroscopic) magnetic toner particles 30 are used, they should have an electrostatic charge opposite to that applied to the surface 12 of the recording element 10.

The magnetic toner particles 30 may comprise particles or iron, nickel, or cobalt. The magnetic toner particles 30 may or may not be coated with a colored thermoplastic resin, depending upon the particular application desired. By the term "magnetic toner particles" used herein, is meant toner particles of materials that are capable of being moved by a magnetic field. Although magnetic toner particles 30 that are electrostatically neutral are preferred, the novel method is not limited to their use, and electroscopic (charge carrying) magnetic toner particles may also be used. The average diameter of the magnetic toner particles is not critical. Particles of a size suitable in prior art electrostatic printing processes may be used. For example, magnetic toner particles 30 of nickel, cobalt, or iron having diameters of between five and twenty microns have provided satisfactory images. When thermoplastically coated, the coating of the magnetic toner particles 30 should be non-tacky and readily removable from an image-receiving surface when cold, and fusible by heat or a solvent for fixing the magnetic toner particles to a surface, if so desired.

Figure 3:
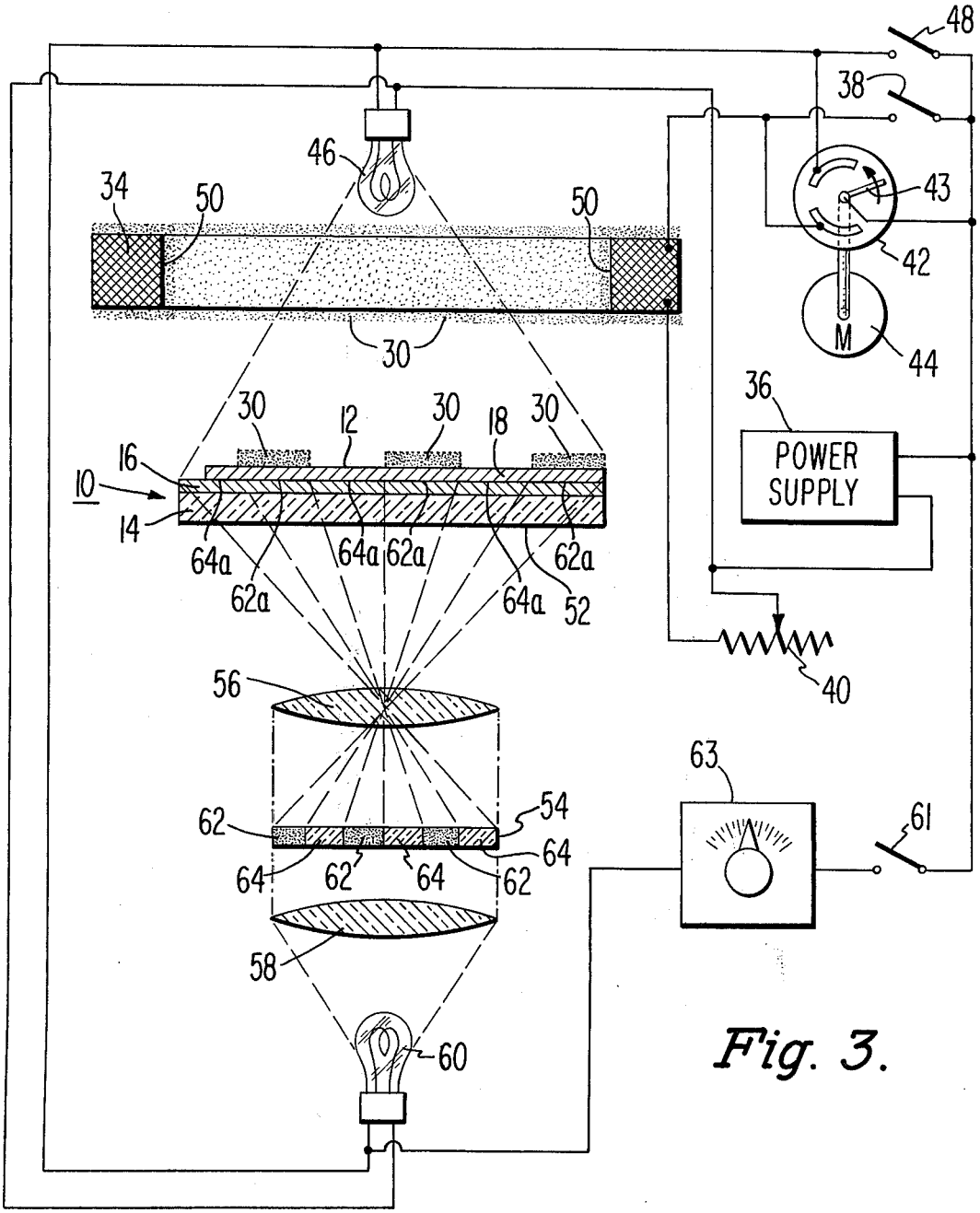
FIG. 3 is a schematic drawing, in side elevation, of the toned recording element disposed in apparatus during the steps of image exposing, flood lighting, and applying a magnetic field to the recording element to increase its sensitivity.

Referring now to FIG. 3 of the drawing, there is shown means for exposing the toned recording element 10 to increase the exposure sensitivity of the toned recording element in a magneto-electric printing system. A magnetic field is provided to exert a magnetic force of attraction upon the magnetic toner particles 30 in a direction to pull them away from the upper surface 12 of the recording element 10. The strength of the magnetic field, however, is adjusted to be just insufficient to remove the magnetic toner particles 30, in darkness, before the recording element 10 is exposed with an image exposure. To this end, a wire coil 34 is disposed adjacent the surface 12 and connected to a source of suitable voltage, such as a power supply 36, to energize it as an electromagnet. The power supply 36 may be an alternating current or direct current power supply. The coil 34 is connected in series with a switch 38 and a variable resistor 40 to the power supply 36. The power supply 36 is also connected to the coil 34 through a rotary switch 42 which is in parallel with the switch 38. A rotary contact 43 of the rotary switch 42 is coupled to a motor 44 for periodically energizing the coil 34 with current for the purpose hereinafter appearing.

The power supply 36 is also connected to a light source, such as a flood light 46, through a switch 48. The light 46 is also connected to the power supply 36 through the rotary switch 42 in a manner whereby the light 46 and the coil 34 may be energized alternately when the rotary switch 42 is actuated by the motor 44. The light 46 is disposed substantially along the longitudinal axis of the coil 34 and is adapted, when energized, to flood the toned surface 12 of the recording element 10 with light. Light rays from the light 46 are directed through the center opening 50 of the coil 34. Although the light 46 is illustrated herein as a filamentary lamp, it may comprise any other suitable source of light, such as a xenon arc, for example.

The recording element 10 is exposed with electromagnetic radiation of an image to be reproduced, preferably through its rear surface 52, that is, through the substrate 14 and the conductive layer 16, by any suitable means. For example, a light image of a photographic transparency 54, such as a photographic positive or negative or a lantern slide, is projected onto the photoconductive layer 18 by means of an optical system, shown in FIG. 3 for illustrative purposes by lenses 56 and 58 and a lamp 60. The lamp 60 is connected in parallel with the light 46 so that both may be energized simultaneously by either the switch 48 or the rotary switch 42. The lamp 60 is also connected to the power supply 36 through a switch 61 and a timer 63 for separate operation from that of the light 46, when so desired.

The method of increasing the image exposure sensitivity of the uniformly toned recording element 10 in a magneto-electric printing system will now be explained with reference to FIG. 3 of the drawing. A (sub-threshold) magnetic field is applied to the system by closing the switch 38 and adjusting the variable resistor 40 so that the strength of the field provided is just insufficient to remove the magnetic toner particles 30 from the uniformly toned surface 12, in darkness, of the yet unexposed recording element. The magnetic field is, however, of a strength sufficient to remove the toner particles 30 upon exposure of the recording element with light from the light image upon exposure thereby. The recording element 10 is now exposed with an image exposure by closing the switch 38 and energizing both the lamp 60 and the flood light 46 for a few seconds, depending on the sensitivity of the photoconductive layer 18 and the intensity of the image exposure. If, for example, the transparency 54 is an image of parallel black and white lines 62 and 64, respectively, as shown, the photoconductive layer 18 is exposed with light in alternate portions **64*a* thereof. No light reaches the alternate portions 62*a* of the photoconductive layer 18 during this image exposure step. Hence, the photoconductivity of the photoconductive layer 18 is increased in the portions 64*a* in proportion to the intensity of light reaching them, and, consequently, the electrostatic forces between the magnetic toner particles 30 and the photoconductive layer 18 are reduced accordingly in these light-struck portions. Under these conditions, the magnetic force provided by the (electromagnet) energized coil 34 causes the affected magnetic toner particles 30 to be pulled from the light-struck portions 64*a* of the photoconductive layer 18 and to be deposited on the surface of the coil 34. The magnetic toner particles 30 can be removed from the coil 34** and reused.

As the magnetic toner particles 30 are in the process of being removed from the surface 12 in the image exposed portions **64*a*, light from the flood light 46 can penetrate the layer of magnetic toner particles 30 (through openings formed by the removed toner particles) and, in a kind of boot-strapping process, still further increase the conductivity of the photoconductive layer 18, thereby further reducing the electrostatic forces between the magnetic toner particles 30 and the photoconductive layer 18 and thus speeding up the image formation on the surface 12. The magnetic toner particles 30 remain on the portions 62***a* of the photoconductive layer 18, because substantially no light from the transparency 54 reaches the photoconductive layer 18 there, and thereby define a copy of the image projected by the transparency 54. The image thus defined functions as a mask through which additional light from the flood light 46 is added to the image exposure to both intensify the image exposure and to decrease the exposure time, thereby increasing the exposure sensitivity of the toned recording element.

The magnetic toner particles 30 that are removed from the upper surface 12 of the recording element 10, during the image exposure step in the instant system, travel in a curved path away from the axis of the coil 34 and ultimately collect on the coil 34. Thus, the magnetic particles 30 removed from the recording element 10 by the magnetic field do not interfere with, or collect on, the light 46.

While the novel method of increasing the image exposure sensitivity of the recording element 10 in a magneto-electric printing system has been described by operations whereby the recording element is exposed with an image directed to one surface and a separate light directed to an opposite surface, as shown in FIG. 3, it is within the scope of the novel method to expose the uniformly toned surface 12 with both the image exposure and the separate flood light directed in the same direction, that is, from the same side of the recording element 10. Such a procedure is possible when the uniformly charged surface 12 is uniformly toned with a relatively thin layer of the magnetic toner particles 30 and where the image exposure is performed with a light image of a relatively bright light intensity. Under the latter conditions, the image exposure is directed directly toward the uniformly charged and toned surface 12 and the light 46 is also directed to the surface 12 by any suitable means at a slight angle thereto. Since the coil 34 is an air-core structure, it does not provide any light-blocking structures to interfere with the exposure of the recording element 10 by light directed through the opening 50 of the coil 34.

In still another embodiment of the novel method for increasing the exposure sensitivity of the uniformly toned recording element 10, the toned recording element 10 is exposed with an image exposure through its light-transmitting substrate 14 while the toned surface 12 is flooded with light from the light 46, as shown in FIG. 3. The motor 44 is energized to rotate the rotary contact 43 of the switch 42 to alternately energize the coil 34 to provide a magnetic field and to expose the recording element with both the image exposure and the flood light 46. The frequency of rotation of the switch 42 will depend upon the intensities of the exposures. Frequencies of between 1 and 60 Hz may be used, but these are not critical. In some cases, it may be desirable to expose the recording element 10 separately from the flood light 46. This can be accomplished by energizing the lamp 60 through the switch 61 and the timer 63.

Although the recording element 10 is shown in a horizontal position in the drawing, the novel method may be practiced with the recording element 10 in any position as long as means are provided to produce a magnetic field in a direction to remove the toner particles 30 from the surface 12 when the recording element is exposed. When the novel method is carried out with the recording element 10 in a position other than horizontal, as shown in FIG. 3, the force of gravity aids the magnetic force provided by the coil 34 to remove the magnetic toner particles 30 during the image exposure step.

It is also within the scope of the present invention to carry out the novel method of increasing the image exposure sensitivity of a recording element of the type comprising a photoconductive layer of zinc oxide in a resin binder on a light-transmitting substrate of relatively electrically conductive paper. Good images have been produced on this type of recording element with each of the aforementioned embodiments of the novel method.

By the terms "light", "light image", or "image exposure", as used herein and in the appended claims is meant electromagnetic radiation, including ultraviolet, infrared, and x-rays, as well as visible light that has an affect upon the conductivity of the photoconductor of the recording element.

I claim:

1. In an electrostatic printing method of the type wherein a uniform electrostatic charge is applied to a photoconductive layer, the charged layer is uniformly toned with magnetic toner particles, and the toned layer is subjected simultaneously to both a light image exposure to which the layer is sensitive and to a subthreshold magnetic field, whereby to selectively remove magnetic toner particles from the light exposed portions of the layer, the improvement of:

applying simultaneously with both the application of said magnetic field and said image exposure a flood light exposure to the toned layer, whereby to enhance the sensitivity of selective magnetic toner particle removal from said layer by speeding up the image formation on said layer.

2. In a method of forming an image on an electrostatically charged surface of a recording element that has been toned with magnetic toner particles, and wherein said recording element comprises a photoconductive layer, the improvement comprising the steps of:

applying a magnetic field adjacent said toned surface, said magnetic field being of an intensity insufficient to remove said magnetic toner particles from said surface in darkness, exposing said toned surface with an image to be formed so as to reduce the electrostatic attraction between the exposed portions of said charged surface and certain of said magnetic toner particles thereat and to cause said certain magnetic toner particles to be removed by said magnetic field, whereby the remaining magnetic toner particles on said surface define said image, and directing a flood light onto said toned surface during said exposing step and while applying said magnetic field, whereby rays of said flood light can further increase the conductivity of said photoconductive layer during the removal of said certain magnetic toner particles from said surface and decrease the exposure time of forming said image on said surface.

3. In a method of forming an image on an electrostatically charged surface of a recording element that has been toned with magnetic toner particles, as described in claim 2, wherein:

the step of exposing said toned surface comprises directing a light image of said image to be formed onto said photoconductive layer from an opposite side of said recording element to that from which said flood light is directed.

4. In a method of forming an image on an electrostatically charged surface of a recording element that has been toned with magnetic toner particles, as described in claim 2, wherein:

the step of exposing said toned surface comprises directing a light image of said image onto said toned surface from the same side of said recording element as that from which said flood light is directed.

5. In a method of forming an image on an electrostatically charged surface of a recording element that has been toned with magnetic toner particles, as described in claim 2, wherein:

said photoconductive layer is on a substrate that is light transparent, and the step of exposing said toned surface comprises directing a light image of said image to be formed through said substrate and onto said photoconductive layer.

6. In a method of forming an image on an electrostatically charged surface of a recording element that has been toned with magnetic toner particles, as described in claim 2, wherein:

said steps of exposing said toned surface and directing a flood light are performed simultaneously with each other but alternately with the step of applying said magnetic field.

7. A method of forming an image on a surface of a recording element comprising a photoconductive layer, said method comprising, in combination, the steps of:

applying a substantially uniform electrostatic charge to tone it, applying magnetic toner particles to said charged surface to tone it, applying a magnetic field adjacent to said surface, said magnetic field being of a strength insufficient to remove said magnetic toner particles from said surface in darkness, but positioned to remove said magnetic toner particles from said surface adjacent light-struck portions of said photoconductive layer, when said photoconductive layer is exposed, exposing said photoconductive layer, while in said magnetic field, with an exposure of the image to be formed to increase the photoconductivity of said photoconductive layer, to reduce the electrostatic attraction between the exposed portions of said photoconductive layer and certain of said magnetic toner particles thereat, and to remove said certain magnetic toner particles from said surface by said magnetic field, whereby the remaining magnetic toner particles on said surface form said image, and directing separate light of substantially uniform intensity onto said toned surface during said exposing step and while in said magnetic field, to flood said toned surface with light, whereby to speed up the forming of said image on said surface.

8. A method of forming an image on a surface of a recording element as described in claim 7, wherein:

said step of exposing said photoconductive layer comprises directing said exposure of the image to be formed toward surface of said photoconductive layer opposite to that of said toned surface.

9. A method of forming an image on a surface of a recording element as described in claim 7 wherein:

said step of exposing said photoconductive layer comprises directing said exposure from the same side of said recording element as said separate light is directed.

10. A method of forming an image on a surface of a recording element as described in claim 7 wherein:

said step of directing a separate light onto said toned surface is performed alternately with said step of applying said magnetic field.

* * * * *